US006527117B2

(12) United States Patent
Adkins et al.

(10) Patent No.: US 6,527,117 B2
(45) Date of Patent: Mar. 4, 2003

(54) PACKAGE FOR THE SALE OF IMAGE-QUALITY PRINTING PAPER AND DISPLAY OF IMAGES PRINTED ON THE PAPER

(76) Inventors: Clifton Ray Adkins, 4618 Billingsgate La., Woodstock, IL (US) 60098; Jason Wyatt Adkins, 4618 Billingsgate La., Woodstock, IL (US) 60098

( * ) Notice: Subject to any disclaimer, the term of this patent is extended or adjusted under 35 U.S.C. 154(b) by 0 days.

(21) Appl. No.: 09/817,495

(22) Filed: Mar. 26, 2001

(65) Prior Publication Data

US 2001/0035365 A1 Nov. 1, 2001

Related U.S. Application Data

(60) Provisional application No. 60/192,469, filed on Mar. 27, 2000.

(51) Int. Cl.[7] ..... B65D 85/48

(52) U.S. Cl. ..... 206/449; 206/215; 206/764

(58) Field of Search ..... 206/215, 449, 206/764; 40/721, 723; 271/145

(56) References Cited

U.S. PATENT DOCUMENTS

| | | | | | |
|---|---|---|---|---|---|
| 877,078 | A | | 1/1908 | Havenhill et al. | |
| 913,054 | A | * | 2/1909 | Robbins | 206/215 |
| 1,388,010 | A | | 8/1921 | Watson | |
| 1,769,719 | A | * | 7/1930 | Smith | 206/215 |
| 2,649,799 | A | | 8/1953 | Spertus | |
| 3,327,886 | A | * | 6/1967 | Short | 206/215 |
| 3,369,730 | A | * | 2/1968 | Bowman | 206/215 |
| 3,377,727 | A | | 4/1968 | Weggeland | |
| 3,557,480 | A | | 1/1971 | Ebner | |
| 3,648,833 | A | * | 3/1972 | Dash | 206/215 |
| 4,423,563 | A | | 1/1984 | Ondricek | |
| 4,571,865 | A | | 2/1986 | Ackeret | |
| 4,691,456 | A | | 9/1987 | Ackeret | |
| 4,801,016 | A | | 1/1989 | Irrgeher | |
| 4,932,529 | A | | 6/1990 | Levine | |
| 4,993,698 | A | * | 2/1991 | Buelens et al. | 271/145 |
| 5,038,935 | A | | 8/1991 | Wenkman et al. | |
| 5,421,111 | A | | 6/1995 | Primm et al. | |
| 5,605,354 | A | | 2/1997 | Kwon | |
| 5,609,252 | A | | 3/1997 | Koch | |
| 5,835,201 | A | | 11/1998 | Itano et al. | |
| 5,996,815 | A | | 12/1999 | Walters et al. | |

* cited by examiner

*Primary Examiner*—David T. Fidei
(74) *Attorney, Agent, or Firm*—Pauley Petersen Kinne & Erickson

(57) ABSTRACT

A package for the sale of image-quality printing paper facilitates digital image printing by providing blank sheets of image-quality printing paper pre-cut to accommodate image printing sizes for personal use. A rigid container is constructed and arranged to provide convenient protection, storage, display, and transportation of the blank sheets and the images subsequently printed thereon. The container may be provided with a multifunctional stand therein.

21 Claims, 4 Drawing Sheets

PACKAGE FOR THE SALE OF IMAGE-QUALITY PRINTING PAPER AND DISPLAY OF IMAGES PRINTED ON THE PAPER

CROSS REFERENCE TO RELATED APPLICATION

This application claims the benefit of provisional U.S. Patent Application Serial No. 60/192,469, filed Mar. 27, 2000.

BACKGROUND OF THE INVENTION

1. Field of the Invention

The present invention relates to point of sale packaging for image-grade printing paper which can be additionally used for display and storage of images printed upon the paper.

2. Background of the Invention

Digital imaging including artwork, photography, or even text, now enjoys wide-spread popularity for personal use. Digital printers such as ink jet, laser jet and dye sublimation printers are becoming popular means for the average consumer to print a variety of images for personal display and in some instances, limited distribution.

High grade papers especially adapted for accepting digital images have been developed for use with these digital printers. Such high grade papers, some grades of which may sometimes be called "photo-finishing papers", will hereinafter be referred to as "image-grade papers," to distinguish them from standard paper used largely for the printing of text and from standard light sensitive photographic papers. Image-grade papers may be adapted for receiving water based inks, used with ink-jet printers which, for example, are currently popular for home use. These papers are adapted to handle the higher water content concomitant with the higher amount of water-based ink used in printing an image as compared to a text based document. These papers may consist of four layers including a receiver layer, a barrier layer, a base layer and a backing layer enabling the paper to set the ink, handle the water and protect the paper from saturation which may lead to paper wrinkling, smearing, and image degradation. Gloss level, fade resistance and wear resistance may also be carefully controlled attributes of these image-grade papers. The paper may become quite expensive to the consumer as its ability to accept and display high resolution printed images becomes more refined.

Currently these image-grade papers are provided to the general public largely in letter size 8.5×11 inch format, packaged in some combination of cardboard and shrink-wrap outer covers. Neither the size of the paper nor its container is particularly suitable for personal printing and display of standard sized images. For example, a typical photograph, or print, may be in 3×5 inch or 5×7 inch format, both of which are accepted by most people as standard and reasonable sizes. Also, for these sizes of prints, or images, a great deal of display hardware, such as various frames, in already extant.

To trim such a printed image from a single sheet of image-grade paper may result in much waste of expensive paper and will require concerted effort by the individual wishing to display the print. If a person prints an image to utilize as much of the 8.5×11 inch paper as possible, then display of the image with ubiquitous frames becomes problematic. Also the 8.5×11 inch format will be recognized as a text format and may be psychologically less pleasing for display. Further, storage of the odd sized prints may be problematic.

Therefore what is needed is a packaging which supplies image-grade paper in traditional image display sizes and formats in order to prevent waste and promote convenience of digital image printing and display for the user. It is further desirable that such packaging be useful for the convenient display or storage, or both, of the images printed thereon.

SUMMARY OF THE INVENTION

The present invention solves the above needs in the art by providing pre-cut image-grade paper sheets for typical image sizes and formats in a sturdy, easily-stored container which may be further used as a display stand for the printed images.

The image-grade papers provided may be adapted for receiving water based inks, used with ink-jet printers which, for example, are currently popular for home use, or the image-grade papers may be adapted for use with other printers which may dispense variously formulated image printing compounds onto the paper.

The container is preferably a rigid plastic case which is lightweight and easily mass produced such as by injection molding. The container preferably has at least one clear, or translucent, or both, surface for facilitating display of a pre-cut sheet upon which an image has been printed by the purchaser. The closed container will provide close fitting halves to protect the expensive image grade paper and may further provide protection for the printed image by affording display in the closed position.

In one embodiment, a specially-adapted stand is provided for the closed paper container whereby display and protection of the printed images, as well as any unused blank sheets, is provided. The stand may alternatively be used inside the container as a means to bias the paper towards the display surface of the container. The stand is preferably constructed and arranged to fit within the container before purchase and has two halves connected by a living hinge to facilitate the proper shape for use as a display stand or provide the bias means as stated above.

The container is preferably provided as a two part box incorporating a closely fitted base and hinged cover allowing the cover to swing through about a 315° arc. According to one such embodiment of the present invention, the cover section can then serve as an upright display easel supported by the base section in an abutting relationship without the need for elaborate hinge or stop mechanisms. The container preferably has at least one internal shelf constructed and arranged to hold the blank paper within the container and to place a printed sheet in a display position.

Through use of the present invention, small scale printing of individualized announcements, artistic portfolios, or other commercial or aesthetic images may be created and conveniently conveyed. Simple image printing and display for personal use is, of course, contemplated.

By correctly sizing the container, ubiquitous storage means such as those available for compact disc storage, may be used to facilitate the storage of the containers when they are used for storing printed images.

DETAILED DESCRIPTION OF THE PREFERRED EMBODIMENT

Figure 1:
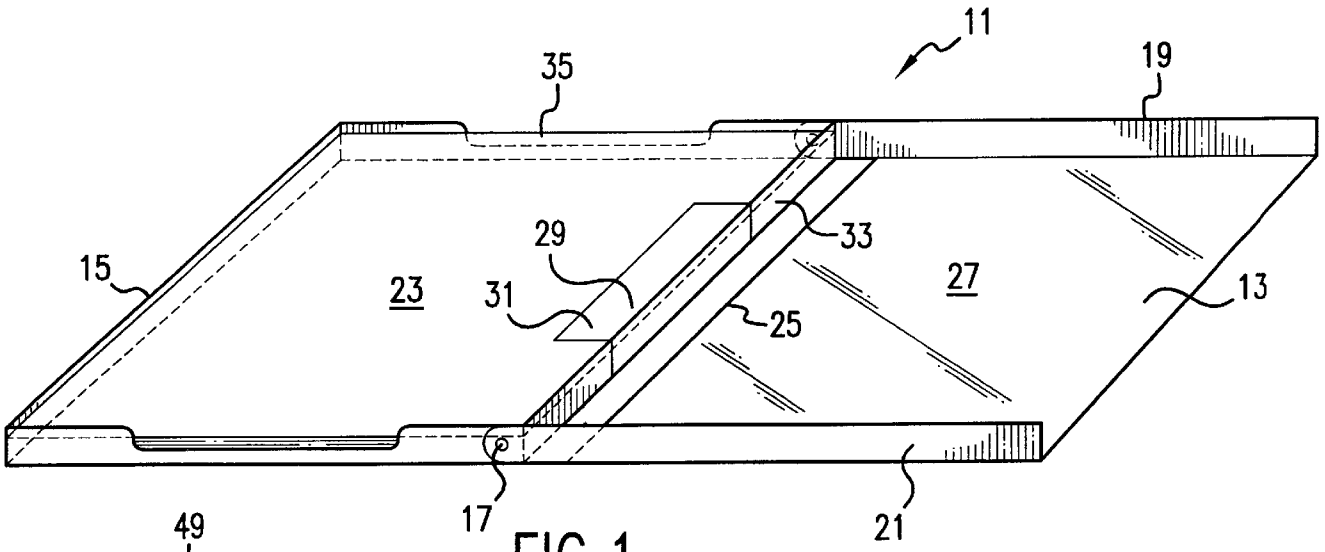
FIG. 1 depicts a laid open position of one embodiment of the container and paper according to one aspect of the present invention.
Figure 3:
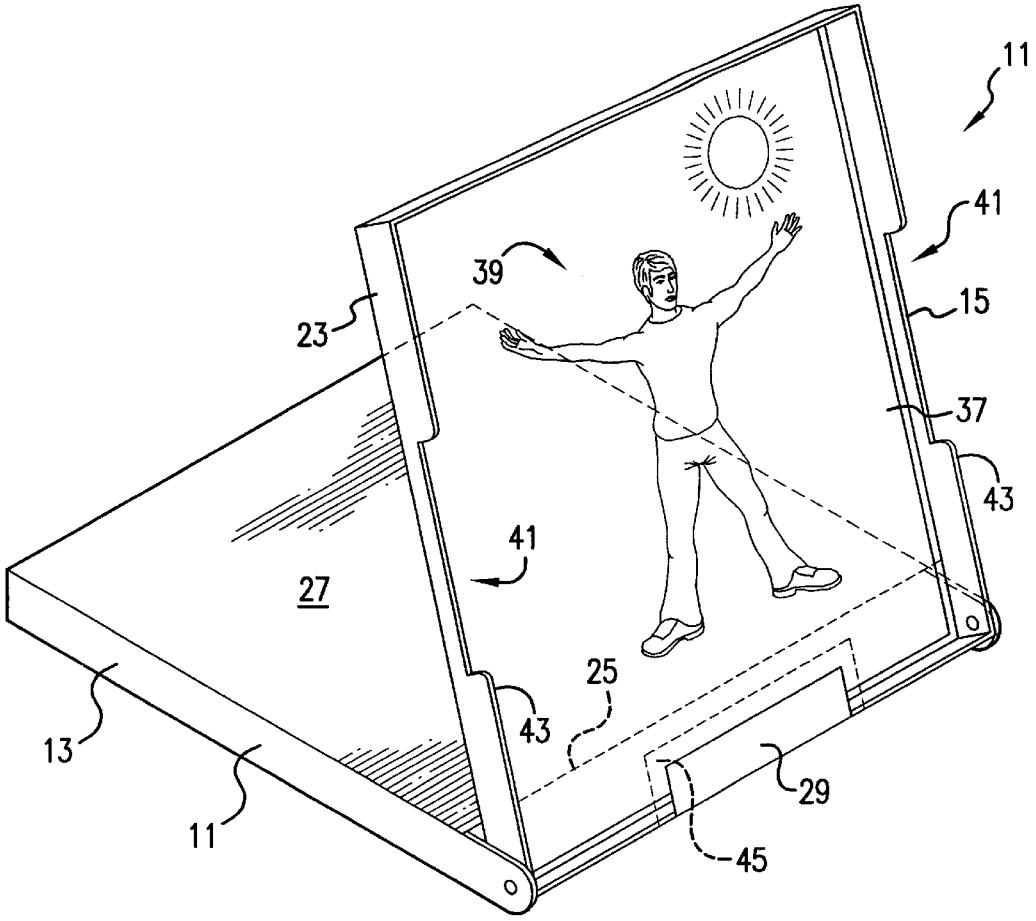
FIG. 3 depicts the embodiment of FIGS. 1 and 2 in a display position.

Referencing FIG. 1, one embodiment of a point of purchase image-quality paper packaging, storage and display container 11 is shown in the open state. The container generally comprises a rigid box structure having a first section 13 serving as a cover or base portion as further explained below, and a second section 15 serving as the paper retaining portion. The first section 13 and second section 15 are hingedly connected by a simple pin-in-hole arrangement 17 on opposing sides 19, 21 of the container 11. The general structure of the container 11 is akin to a common compact disc case and may be congruently sized therewith to utilize compact disc storage racks. The hinged portions of the first and second sections 13, 15 are constructed to allow the sections to rotate freely through about 315° until the major surface 23 of the second section 15 abuts an edge 25 of the major surface of the first section 13, as shown in FIG. 3.

The container is suitably formed by injection molding crystal polystyrene, K-resin, or a combination thereof, although other materials may be found suitable. The entire container may be translucent and clear although only the second section major surface 23 needs to be clear in an embodiment such as FIG. 5 where the container 11 is closed and yet utilized as a display. Alternatively as seen in FIG. 3, the container 11 may be utilized in an open position as a display, leaving the image exposed to the air and thus requiring no clear surfaces on the container 11. Certain embodiments of the present invention may utilize ultraviolet (UV) light inhibitors or colors in the material of the container if desired.

The second section 15 is shown with a single shelf 29, provided with a lip 31 extending parallel to the major surface 23 from a side wall 33 of the second section. The shelf 29 is provided as a simple means for releasably holding blank paper sheets 35 within the second section 15. The lip 31 may be sized at 2.9×0.46 inches in an embodiment sized congruently with a standard compact disc case, sometimes also called a jewel box or case. The ordinarily skilled artisan will appreciate that various constructions may be utilized for the paper-holding function without departing from the scope of the present invention.

The paper 35 is sized to fit closely within the confines of the container 11. The paper 35 and the container 11 are preferably provided in sizes close to standard image printing formats such as three by five (3×5) inch, four by six (4×6) inch, or five by seven (5×7) inch, all of which may utilize to some degree storage containers mass produced for the storage of compact disc containers. A standard compact disc container, or jewel box, has outer dimensions of 4.92 inches by 5.65 inches by 0.41 inch. The present invention may utilize the injection molds of jewel boxes with minimal modifications.

The paper is preferably a premium quality image-grade blank paper at greater than 20 pound weight and a brightness ratio of 92 or more as will be understood by those of skill in the paper arts. More preferably, the image-grade blank paper is of the highest quality for image reproduction such as coated or glossy so called "photo printing" papers. A variety of paper grades may also be provided in a single container allowing the consumer to test printing on less expensive grade paper before committing to a print on the most expensive grade of paper provided. At a depth of 0.41 inch, the container 11 will generally hold 14–20 such blank sheets of image-grade printing paper. By pre-sizing the paper to meet standard image sizes and/or formats, the present invention will result in less waste of the expensive image-grade papers, as well as less wasted packaging, and minimal effort on the part of the individual who wishes to print a stored visual image.

Figure 2:
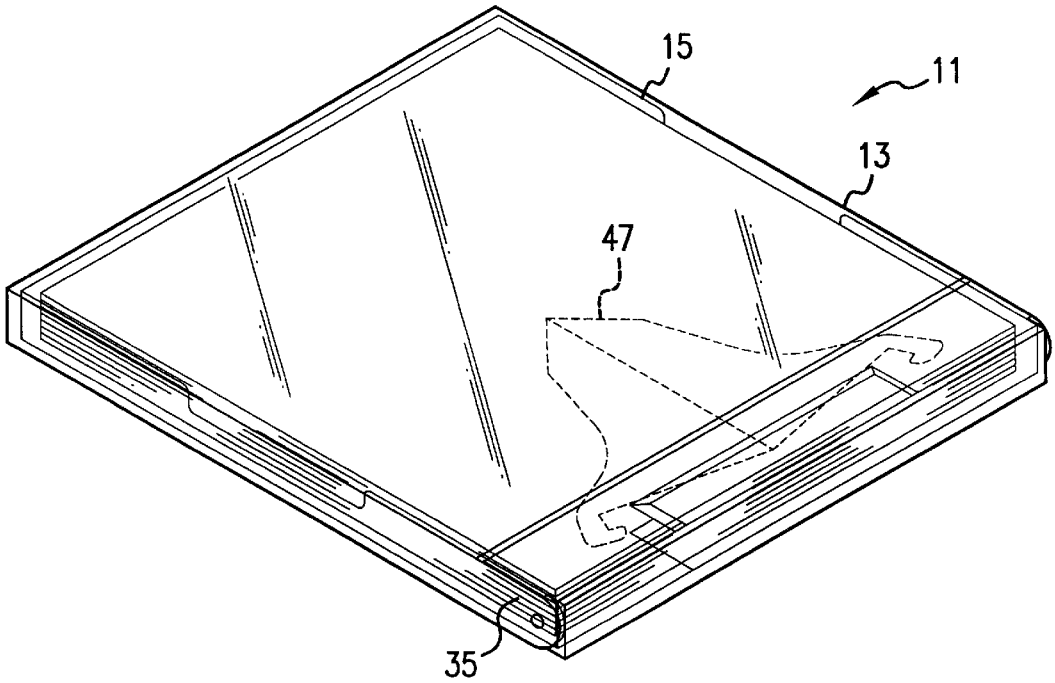
FIG. 2 depicts the embodiment of FIG. 1 in a closed position.

Referencing FIG. 2, the container 11 is shown in a closed position with the first section 13 and the second section 15 releasably engaged and containing the multiple sheets of blank image-grade printing paper 35 therein. Also indicated therein is a stand 47, as further explained below. Sales, branding, or identifying indicia may be easily placed into the container 11 and remain visible when the container, or parts thereof, are constructed from translucent materials. A wrapping may also be placed over the container 11 to protect both the container, or a display surface thereof, and the paper 35, if desired.

Referencing FIG. 3, the container 11 is shown in one possible display position. The first and second sections 13, 15 have been disengaged from their closed position (FIG. 2) and rotated through about a 315° arc placing the second section at about a 45° angle when the first section 13 is placed on the horizontal to act as a base for supporting the upright second section 15. A single paper sheet 37 having an image 39 printed thereon, has been placed in the shelf 29 with the image facing away from the second section major surface 23 for display. Cutaways 41 may be provided in opposing side walls 43 of the second section 15 to provide for ease of paper handling. The second section major surface 23 abuts the first section major surface 27 at an edge 25 thereof. A cutaway 45 in the second section major surface 23 behind the shelf 29 may be provided for ease of molding.

Figure 4:
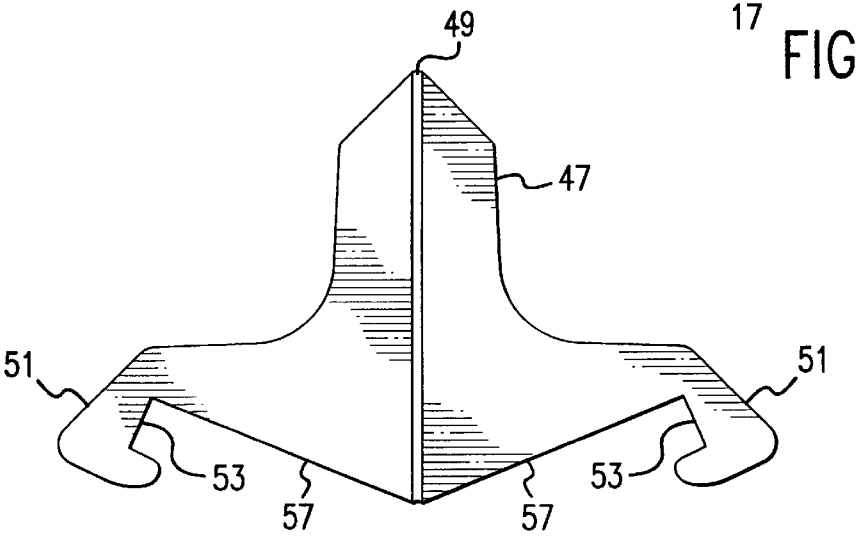
FIG. 4 depicts a laid flat position of one embodiment of a multipurpose stand according to one aspect of the present invention.
Figure 5:
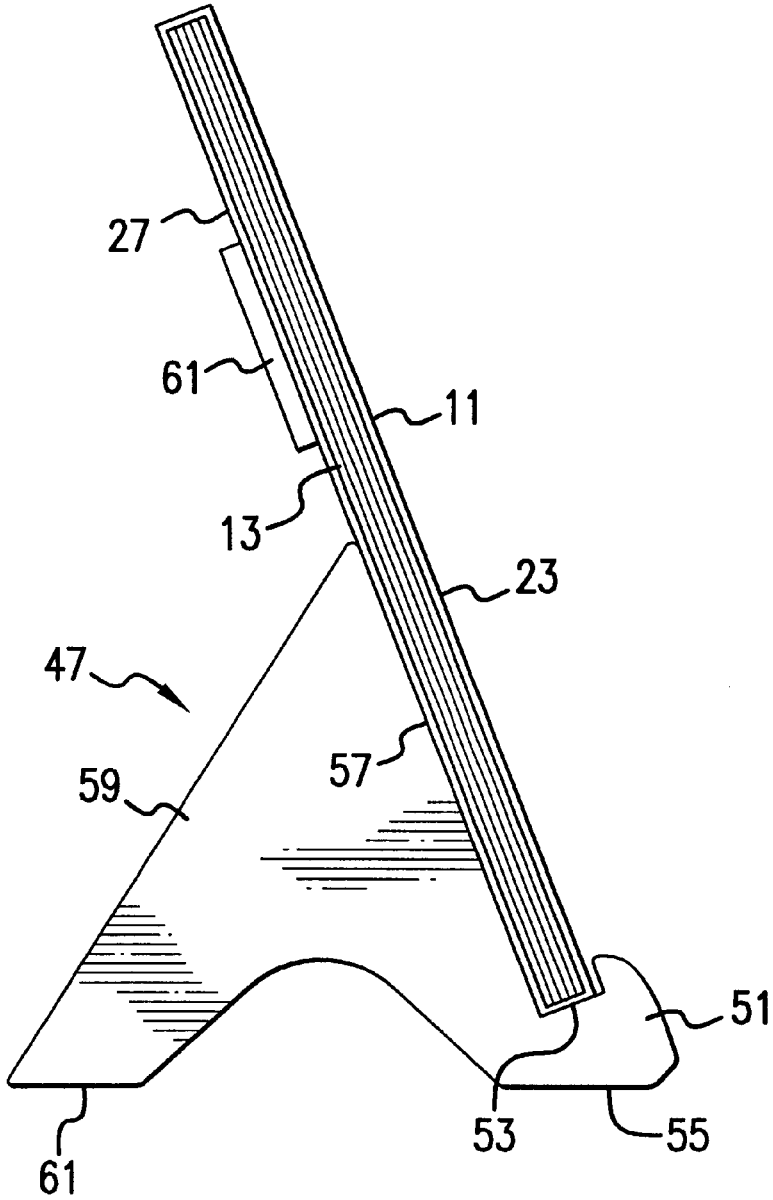
FIG. 5 depicts a side view of the stand of FIG. 4 and the container arranged in an alternative display position.

Referencing FIGS. 4, the stand 47 is shown in a laid flat position. The stand 47 is preferably a bilaterally symmetrical one piece apparatus molded from a resilient plastic polymer. The line of symmetry is a thinned area serving as a living hinge 49. Also referencing FIG. 5, the living hinge 49 allows the halves of the stand 47 to be folded downward whereby inside portions 53 of support hooks 51 integral to each half of the stand 47 may support the container 11. Outside portions 55 of support hooks 51 are configured to contact a horizontal surface. Contiguous with each support hook 51 is an angled front edge 57 serving as further support for the container 11 in the display position (FIG. 5). Rearward of the angled edge 57, the body 59 of the stand 47 forms the remainder of the support structure and provides an additional edge 61, contiguous with outside portions 55, for each stand half for contacting the horizontal surface on which the stand rests. Due to the resilient nature of the living hinge 49, once the stand 47 has been folded in half it will have a tendency to assume a partially flattened shape thereby making the hinge 49 useful as a biasing means for urging a paper sheet 37 towards a major surface, e.g., 23, of the container 11 when the stand 49 is replaced inside the container 11, as shown in FIG. 2.

A magnet 61 may be glued to the outside of the major surface 27 of the first section 13 to aid in using the container 11 as a display in the closed position without the aid of the stand 47. The magnet 61 will provide means for attachment of the container to a separate surface nonintegral with said container surfaces, such as a refrigerator door or the like. In nonpreferred embodiments, the container 11 may have additional means for aiding in display, such as holes in the container or appendages thereon, for receiving mounting means such as picture hooks or the like.

Having thus described an exemplary embodiment of the point of sale package for the sale of image-quality printing paper serving as a display means for printed images, it will be appreciated that many variants of the described embodiment may occur to person of ordinary skill in the art. The scope of the present invention is not intended to be limited by the described embodiment, but only by the appended claims.

We claim:

1. An apparatus for the point of purchase packaging of image-grade paper, and the display of images printed on the paper, comprising:

a) a rigid container having a first section and a second section, the first section having a major surface and at least one side wall perpendicular to the first section major surface, the second section having a major surface and at least one side wall perpendicular to the second section major surface, the first and second sections being hingedly connected and releasably engageable to form an enclosure in an engaged position of the first and second sections, one of the first and second sections having means for releasably supporting a plurality of paper sheets; and b) a plurality of blank sheets of image-grade paper contained within the container, the sheets sized to fit within one of the first and second sections, c) at least one surface of each sheet being constructed and arranged for accepting and retaining image printing compounds; and d) the hinge allowing a rotation of the first section greater than 270 degrees from an engaged position with the second section, whereby the second section acts as a base for support of the first section in an upright display position.

2. The apparatus of claim 1 further comprising: the paper constructed and arranged to maintain high-resolution images thereon.

3. The apparatus of claim 1 further comprising: the paper constructed and arranged to have a weight greater than 20 pounds and a brightness rating greater than or equal to 92.

4. The apparatus of claim 1 wherein the means for releasably supporting a plurality of paper sheets is a single shelf with a retaining surface parallel to one of the major surfaces.

5. An apparatus for the point of purchase packaging of printing paper, and the display of images printed on the paper, comprising:

a) a rigid container having a first section and a second section, the first section having a major surface and at least one side wall perpendicular to the first section major surface, the second section having a major surface and at least one side wall perpendicular to the second section major surface, the first and second sections being hingedly connected and releasably engageable to form an enclosure in an engaged position of the first and second sections, one of the first and second sections having means for releasably supporting a plurality of paper sheets; and b) a plurality of blank sheets of paper contained within the container, the sheets sized to fit within one of the first and second sections, at least one surface of each sheet being constructed and arranged for accepting and retaining image printing compounds; and a stand capable of supporting the container, the stand being substantially flat in a first position and sized to fit within the container when the first and second sections are engaged, and foldable to a second position whereby the stand will support the container.

6. The apparatus of claim 5 wherein the stand is made from a resilient material.

7. The apparatus of claim 5 wherein the stand has first and second halves connected by a living hinge, the stand being usable as a biasing means within the container for urging a piece of the paper against one of the major surfaces.

8. The apparatus of claim 1 further comprising: the container being of a standard commercial compact disc case size.

9. The apparatus of claim 8 wherein the dimensions of the container are 4.92 inches by 5.65 inches by 0.41 inches.

10. The apparatus of claim 1 further comprising: at least one of the major surfaces being translucent.

11. The apparatus of claim 10 wherein the translucent surface further comprises a UV light inhibitor.

12. The apparatus of claim 1 further comprising: all surfaces of the container being translucent.

13. The apparatus of claim 1 further comprising: means for attachment of the container to a separate surface nonintegral with said container surfaces.

14. The apparatus of claim 13 wherein the means for attachment of the container to a separate surface nonintegral with said container surfaces comprises a magnet.

15. A method of packaging point of purchase image-grade paper, and the display of images printed on the paper, comprising:

a) providing a rigid container having a first section and a second section, the first section having a major surface and at least one side wall perpendicular to the first section major surface, the second section having a major surface and at least one side wall perpendicular to the second section major surface, hingedly connecting the first and second sections so as to be releasably engageable to form an enclosure in an engaged position of the first and second sections; and b) placing a plurality of blank sheets of image-grade paper within the container, the sheets sized to fit within one of the first and second sections, at least one surface of each of the sheets being constructed and arranged for accepting and retaining image printing compounds, and c) placing the first and second sections in the engaged position and allowing a rotation of the first section greater than 270 degrees from the engaged position with the second section, whereby the second section acts as a base for support of the first section in an upright display position.

16. The method of claim 15 further comprising: providing paper constructed and arranged to maintain high-resolution images thereon.

17. The method of claim 15 further comprising: providing one the first and second sections with means for releasably supporting a plurality of paper sheets within the container.

18. A method of packaging point of purchase printing paper, and the display of images printed on the paper, comprising:

a) providing a rigid container having a first section and a second section, the first section having a major surface and at least one side wall perpendicular to the first section major surface, the second section having a major surface and at least one side wall perpendicular to the second section major surface, hingedly connecting the first and second sections so as to be releasably engageable to form an enclosure in an engaged position of the first and second sections; and b) placing a plurality of blank sheets of image-grade paper within the container, the sheets sized to fit within one of the first and second sections, at least one surface of each of the sheets being constructed and arranged for accepting and retaining image printing compounds, placing the first and second sections in the engaged position; and providing within the container a stand capable of supporting the container, the stand being substantially flat in a first position and sized to fit within the container when the first and second sections are engaged and foldable to a second position whereby the stand will support the container.

19. The method of claim 15 further comprising: providing at least one translucent major surface.

20. An apparatus for the point of purchase packaging of image-grade paper, and the display of images printed on the paper, comprsing:

a) a rigid container having a first section and a second section, the first section having a major surface and at least one side wall perpendicular to the first section major surface, the second section having a major surface and at least one side wall perpendicular to the second section major surface, the first and second sections being hingedly connected and releasably engageable to form an enclosure in an engaged position of the first and second sections, one of the first and second sections having means for releasably supporting a plurality of paper sheets; and b) a plurality of blank sheets of image-grade paper contained within the container, the sheets sized to fit within one of the first and second sections, c) at least one surface of each sheet being constructed and arranged for accepting and retaining image printing compounds; and d) at least one of the major surfaces being translucent, the translucent surface further comprising a UV light inhibitor.

21. A method of packaging point of purchase image-grade paper, and the display of images printed on the paper, comprising:

a) providing a rigid container having a first section and a second section, the first section having a major surface and at least one side wall perpendicular to the first section major surface, the second section having a major surface and at least one side wall perpendicular to the second section major surface, hingedly connecting the first and second sections so as to be releasably engageable to form an enclosure in an engaged position of the first and second sections; and b) placing a plurality of blank sheets of image-grade paper within the container, the sheets sized to fit within one of the first and second sections, at least one surface of each of the sheets being constructed and arranged for accepting and retaining image printing compounds, and c) providing at least one translucent major surface, the at least one translucent major surface having a UV light inhibitor.

* * * * *